US009643295B1

(12) United States Patent
Mayta

(10) Patent No.: US 9,643,295 B1
(45) Date of Patent: May 9, 2017

(54) SANDING BLOCK

(71) Applicant: Bradley J Mayta, Walnut Creek, CA (US)

(72) Inventor: Bradley J Mayta, Walnut Creek, CA (US)

( * ) Notice: Subject to any disclaimer, the term of this patent is extended or adjusted under 35 U.S.C. 154(b) by 0 days.

(21) Appl. No.: 14/824,924

(22) Filed: Aug. 12, 2015

(51) Int. Cl.
*B24D 15/02* (2006.01)

(52) U.S. Cl.
CPC ..... *B24D 15/023* (2013.01)

(58) Field of Classification Search
CPC ..... B24D 15/023
USPC ..... 451/552–558
See application file for complete search history.

(56) References Cited

U.S. PATENT DOCUMENTS 2,457,045 A 12/1948 Kitterman
2,595,428 A * 5/1952 Trussell ..... B24D 15/023 451/502
2,595,429 A * 5/1952 Trussell ..... B24D 15/023 451/523
2,626,490 A * 1/1953 Meers ..... B24D 15/023 15/231
2,804,729 A * 9/1957 Dahlstrom ..... B24D 15/04 451/503
2,911,769 A * 11/1959 Trussell ..... B24D 15/023 451/503
3,410,035 A 11/1968 Gohde
3,510,991 A 5/1970 Bowen
4,242,843 A * 1/1981 Phillips ..... B24D 15/023 15/233
4,501,096 A * 2/1985 Lukianoff ..... B24D 15/023 451/502
4,525,959 A * 7/1985 Ziebarth ..... B24D 15/023 451/504
4,640,060 A * 2/1987 Lukianoff ..... B24D 15/023 451/490
4,887,396 A * 12/1989 Lukianoff ..... B24D 15/04 451/523
5,007,483 A * 4/1991 McGuire ..... A01L 15/00 168/48.1
5,177,909 A * 1/1993 Klocke ..... B24D 15/023 451/490
5,522,763 A * 6/1996 Regnier ..... B24D 15/04 451/502
5,588,904 A * 12/1996 Allport ..... B24D 15/023 451/512
D406,515 S 3/1999 Ali
6,062,966 A * 5/2000 Ali ..... B24D 15/04 451/503
6,138,884 A * 10/2000 Gish ..... B24D 11/008 225/1
6,142,868 A * 11/2000 Pfanstiehl ..... B05C 17/00 15/169

(Continued)

*Primary Examiner* — George Nguyen
(74) *Attorney, Agent, or Firm* — Richard L. Miller

(57) ABSTRACT

A hand-held sanding block used by a hand of a user, replaceably holds sheet sandpaper, prevents the sheet sandpaper held therein from unintentional removal therefrom during use, and does not collapse under heavy pressure from the hand of the user during use. The hand-held sanding block includes a body. The body is used by the hand of the user, replaceably holds the sheet sandpaper, prevents the sheet sandpaper held therein from unintentional removal therefrom during use, and does not collapse under the heavy pressure from the hand of the user during use.

37 Claims, 11 Drawing Sheets

SECOND METHOD OF LOADING THE SHEET SANDPAPER (26) ONTO THE HAND-HELD SANDING BLOCK (20)

(56) References Cited

U.S. PATENT DOCUMENTS

| | | | | |
|---|---|---|---|---|
| 6,213,857 | B1 * | 4/2001 | Duquette | B24D 15/023 451/513 |
| 6,835,124 | B2 | 12/2004 | Stephan | |
| 7,364,501 | B2 | 4/2008 | Ali et al. | |
| 8,388,419 | B2 | 3/2013 | Koenig, Jr. | |
| 8,585,471 | B2 | 11/2013 | Shabla | |
| 2002/0090902 | A1 * | 7/2002 | Draper | B24D 15/023 451/552 |

* cited by examiner

SECOND METHOD OF LOADING THE SHEET SANDPAPER (26) ONTO THE HAND-HELD SANDING BLOCK (20)
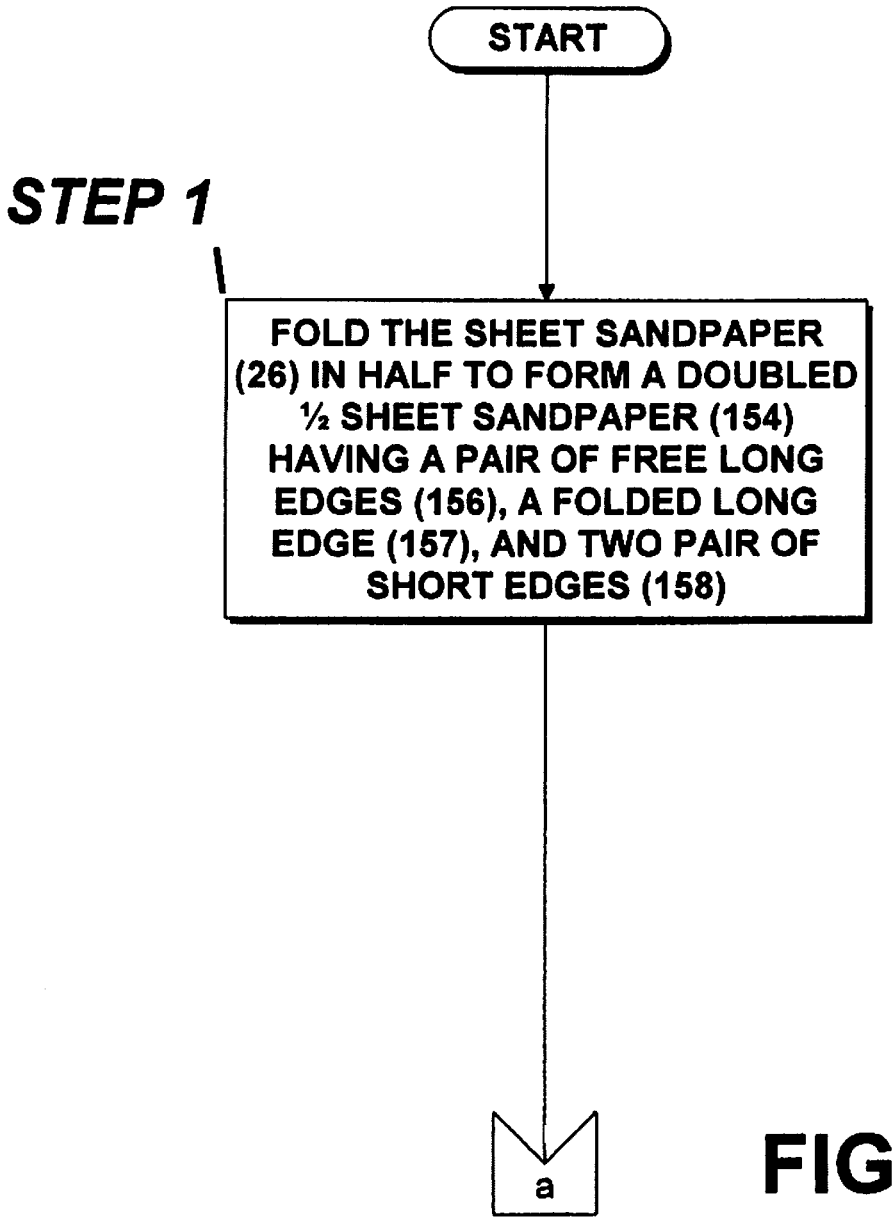
FIG. 15-A

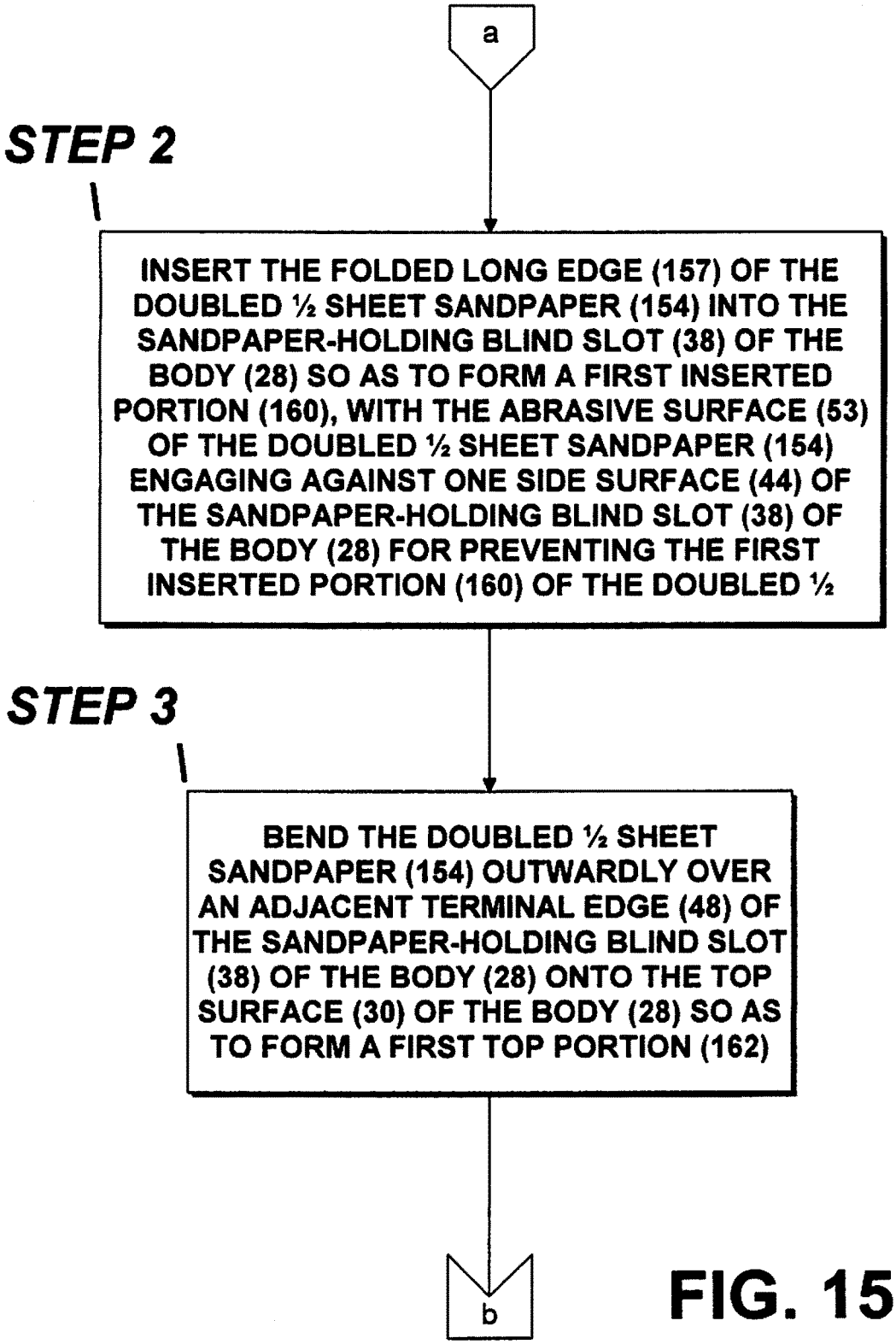
FIG. 15-B

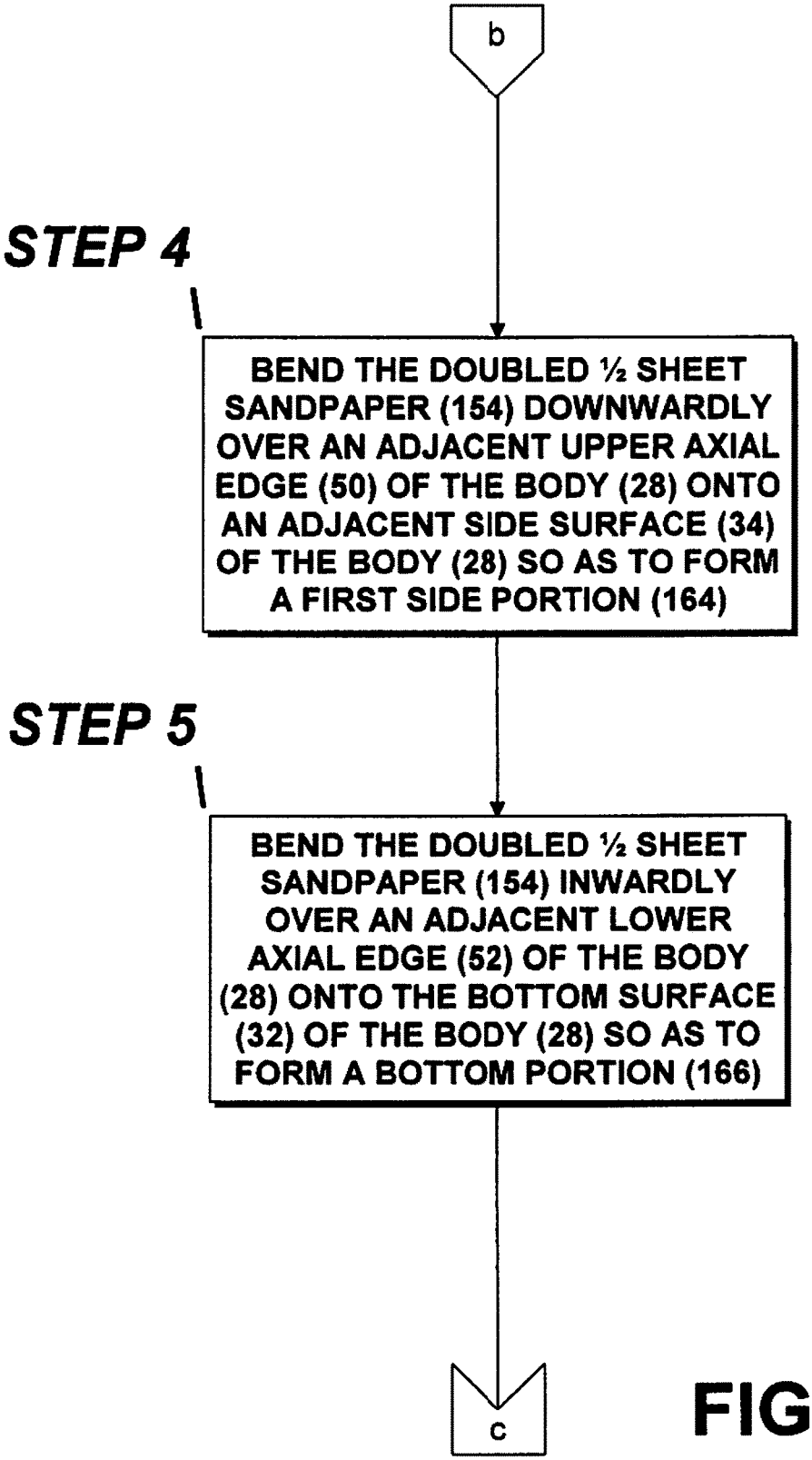
FIG. 15-C

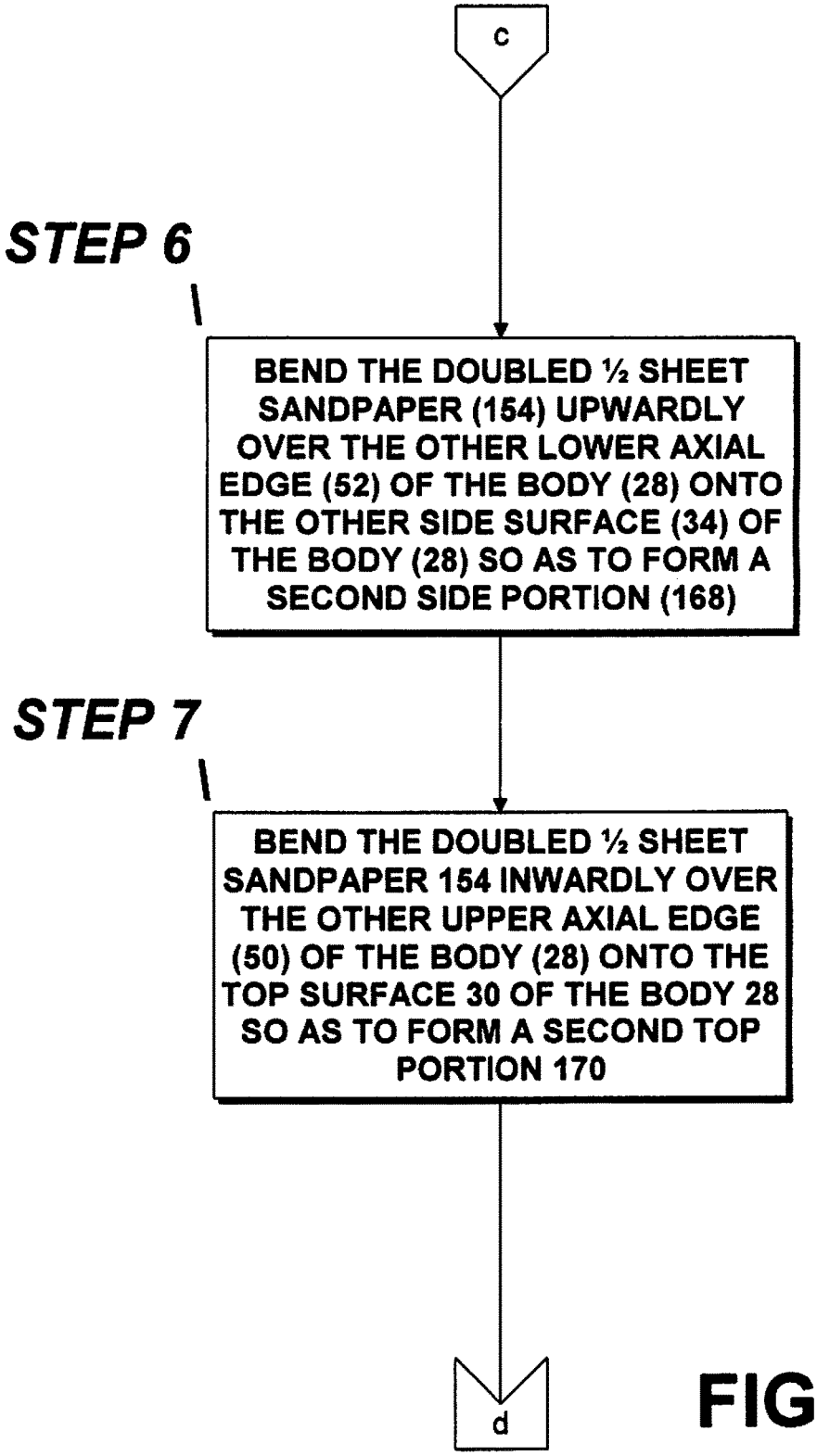
FIG. 15-D

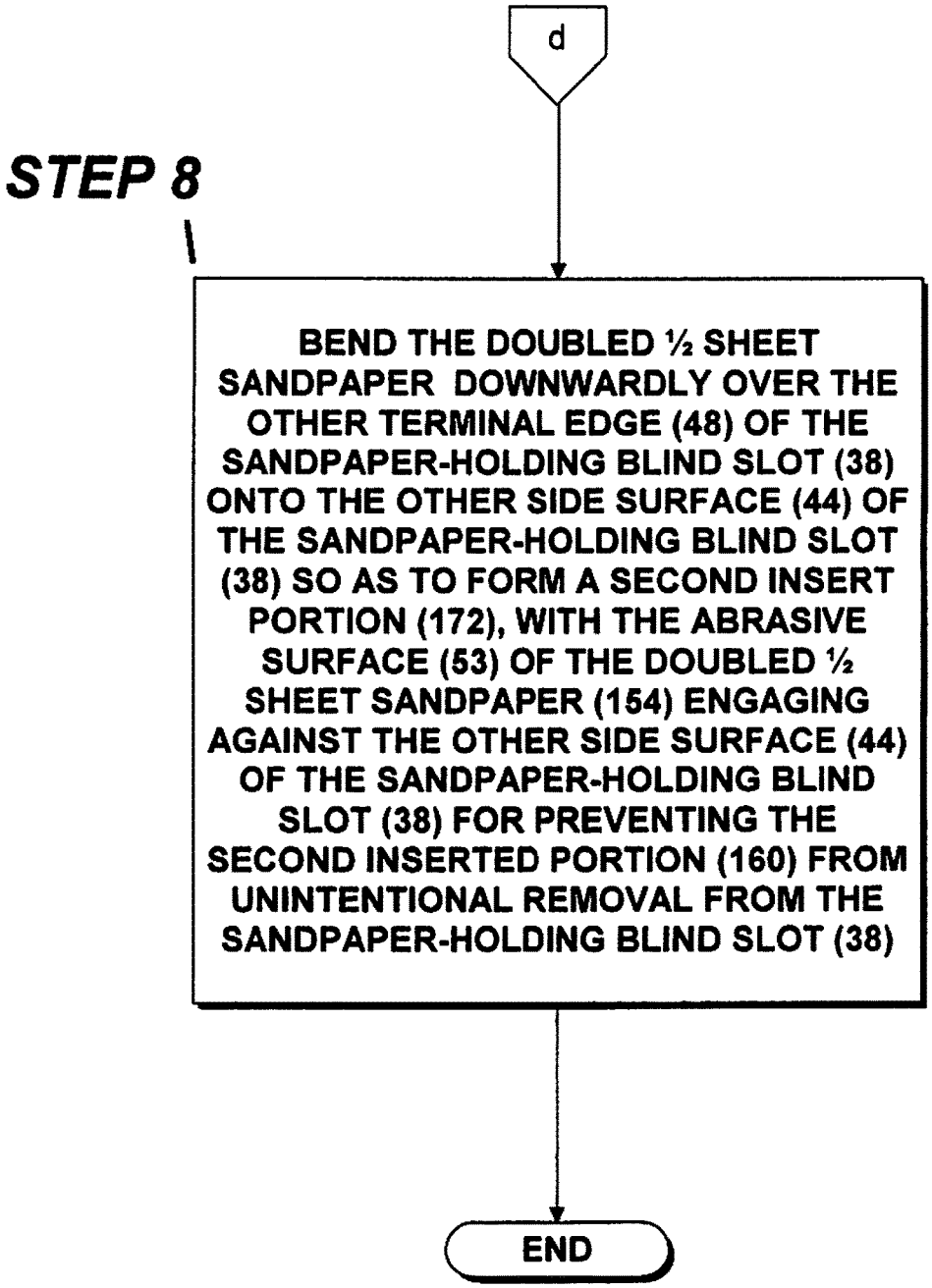
FIG. 15-E

SANDING BLOCK

BACKGROUND OF THE INVENTION

Field of the Invention

The present invention relates to a block, and more particularly, a sanding block.

Description of the Prior Art

Numerous innovations for sanding blocks have been provided in the prior art that will be described. Even though these innovations may be suitable for the specific individual purposes to which they address, however, they differ from the present invention.

A FIRST EXAMPLE, U.S. Pat. No. 2,457,045, Issued on Dec. 21, 1948, to Kitterman teaches a top block member formed with a longitudinally extending slot in its upper surface, an inverted V-shape clamping strip disposable therein, and a pair of wedge-shaped block members supported below the top member. An intermediate or upper wedge-shaped block member is longitudinally slotted and movable with respect to the top block member. Securing screws extend through a lower wedge-shaped block member and through the slot in the intermediate block member onto the top block member, and sheet of sandpaper disposed about the block members and having its opposite edges secured in the slot in the top of the top block member by way of the inverted V-shape clamping strip.

A SECOND EXAMPLE, U.S. Pat. No. 3,410,035, Issued on Nov. 12, 1968, to Gohde teaches a body member grabble for hand sanding operations. The body member has a slot at one end for anchoring one end of a piece of sandpaper and has a pronged gripping member at the other end for anchoring the other end of the piece of sandpaper. The body member has top walls extending toward each other from the opposite ends. The top walls terminate short of each other to form a top opening compartment formed by the side walls of the body member and intermediate vertical wall portions.

A THIRD EXAMPLE, U.S. Pat. No. 3,510,991, Issued on May 12, 1970, to Bowen teaches a sanding block for supporting a continuous loop sand block, which includes first and second blocks positioned in the belt with adjacent ends of the block having aligned slots with inwardly inclined bottom surfaces in which opposing cam members are positioned for being moved inwardly and expanding the blocks in a n outward longitudinal direction against the sanding belt making a rigid composite structure.

A FOURTH EXAMPLE, U.S. Pat. No. 6,835,124, Issued on Dec. 28, 2004, to Stephan teaches a sanding block holding a continuous loop sanding belt tightly thereon. The block includes a hollow block body including a spring clamp having top and bottom racks of serrated indented teeth that extend longitudinally therein forming the top and bottom gear racks. Each of these gear racks engages reciprocal top and bottom gear racks having serrated indented teeth extending longitudinally along top and bottom forked members the spring clamp. The spring clamp is positioned within the hollow block body so that the continuous loop sanding belt can be tightly fit over the hollow block body.

A FIFTH EXAMPLE, U.S. Pat. No. 7,364,501, Issued on Apr. 29, 2008, to Ali, et al. teaches a sanding block including a compressible core having at least one pair of sides characterized so that an abrasive material is adhered to the sides substantially along the surface thereof, and having a juncture area defined between the two sides the does not have the abrasive material adhered thereto so that the abrasive material does not run continuously about the sides of the core thereby providing the two sides to be readily compressed toward one another. A method of forming the sanding block is also taught.

A SIXTH EXAMPLE, U.S. Pat. No. 8,388,419, Issued on Mar. 5, 2013, to Koenig, Jr. teaches a sanding block having two expansive sides and two adjacent sides. Each adjacent side adjoins each expansive side at a given one of two opposite edges of that expansive side. The expansive and adjacent sides are abrasive. When viewed macroscopically before the sanding block becomes worn, the expansive sides between their opposite edges are planar and are parallel. A given one of the opposite edges of each expansive side is a curved edge that defines a radius not less than about ⅛" at any location on the curved edge. The other one of the opposite edges of each expansive side is a sharp edge that defines an acute angle in a range from about 55° to about 70°. The curved edges are intended to minimize gouging or scuffing due to uneven pressure being applied by a user holding the sanding block in one hand and to minimize damage when gouging or scuffing due thereto occurs.

A SEVENTH EXAMPLE, U.S. Pat. No. 8,585,471, Issued on Nov. 19, 2013, to Shabla teaches a sanding block including a support block having a right side and a left side. A gripping slot extends from the right side to the left side. The gripping slot is capable of receiving ends of a sheet of sandpaper folded around the support block.

AN EIGHTH EXAMPLE, U.S. Pat. No. Des. 406,515, Issued on Mar. 9, 1999, to Ali teaches the ornamental design for a sanding block.

It is apparent now that numerous innovations for sanding blocks have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a sanding block that avoids the disadvantages of the prior art.

ANOTHER OBJECT of the present invention is to provide a sanding block that is simple and inexpensive to manufacture.

STILL ANOTHER OBJECT of the present invention is to provide a sanding block that is simple to use.

BRIEFLY STATED, STILL YET ANOTHER OBJECT of the present invention is to provide a hand-held sanding block used by a hand of a user, replaceably holds sheet sandpaper, prevents the sheet sandpaper held therein from unintentional removal therefrom during use, and does not collapse under heavy pressure from the hand of the user during use. The hand-held sanding block includes a body. The body is used by the hand of the user, replaceably holds the sheet sandpaper, prevents the sheet sandpaper held therein from unintentional removal therefrom during use, and does not collapse under heavy pressure from the hand of the user during use.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 15A-15E are a flowchart for a method of loading sheet sandpaper onto the sanding block.

A MARSHALING OF REFERENCE NUMERALS UTILIZED IN THE DRAWING

Introductory

Figure 1:
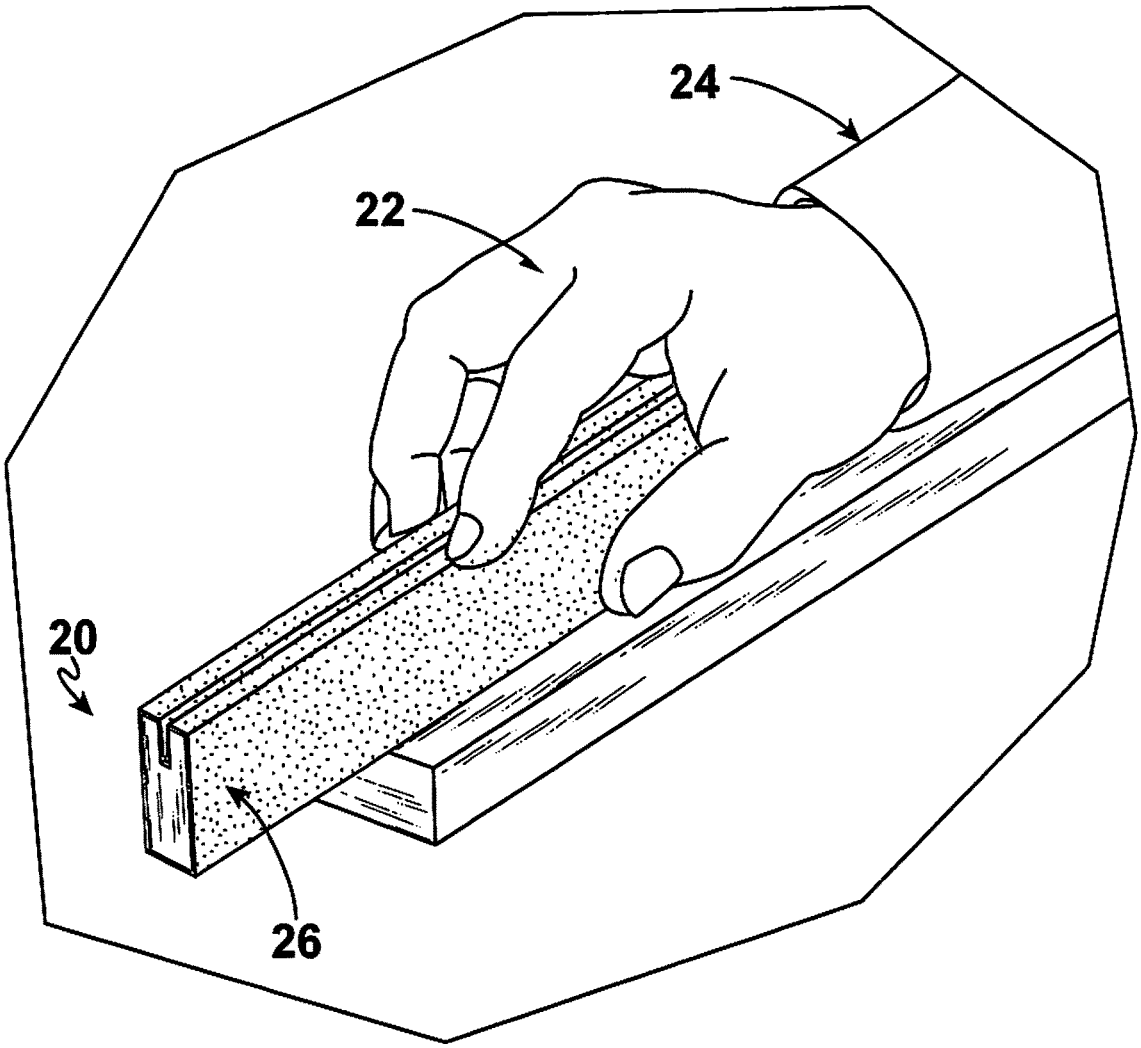
FIG. 1 is a diagrammatic perspective view illustrating an embodiment of the sanding block with sandpaper installed thereon in use.
Figure 2:
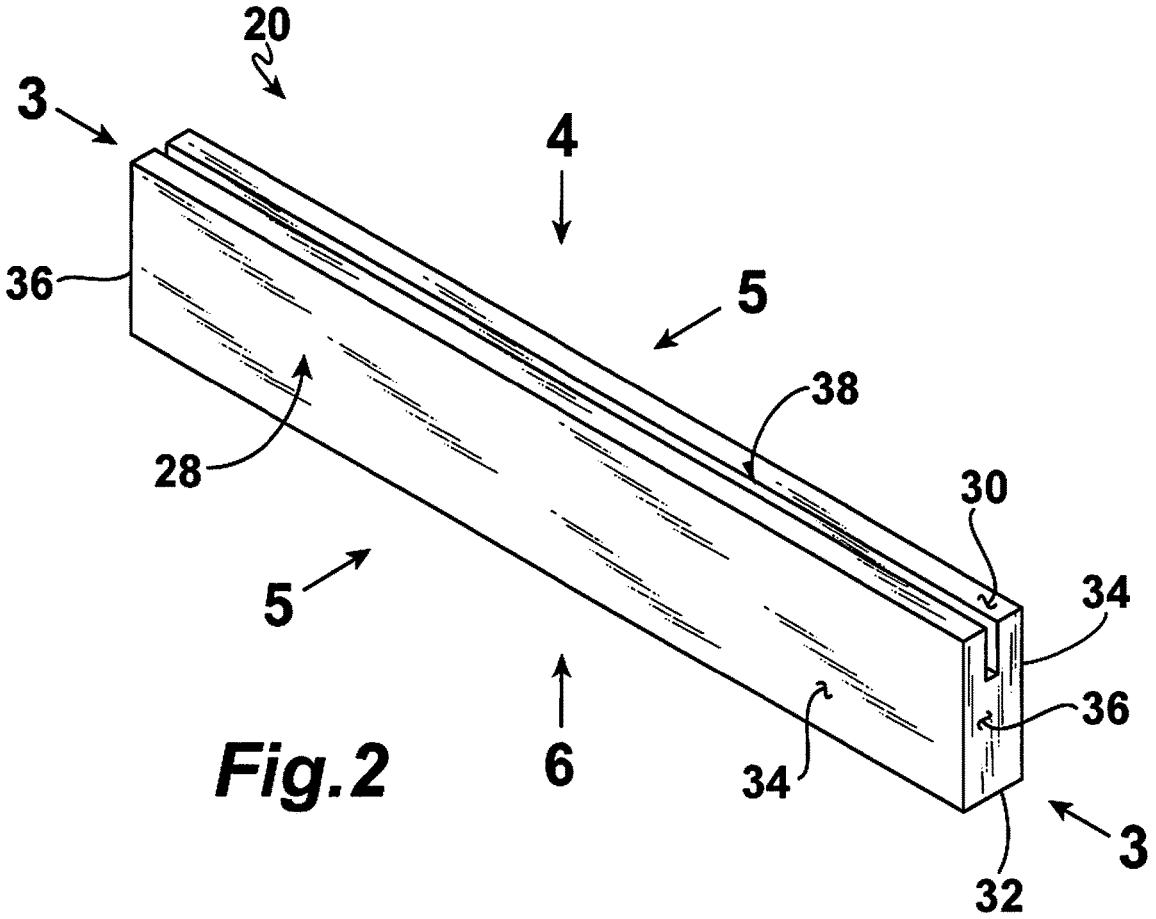
FIG. 2 is a diagrammatic perspective view illustrating an embodiment of the sanding block per se and without any sandpaper installed thereon.

20 hand-held sanding block of embodiments of present invention for being used by hand 22 of user 24, for replaceably holding sheet sandpaper 26, for preventing sheet sandpaper 26 held therein from unintentional removal therefrom during use, and for not collapsing under heavy pressure from hand 22 of user 24 during use

22 hand of user 24

24 user

26 sheet sandpaper

Configuration of Hand-Held Sanding Block 20

28 body for being used by hand 22 of user 24, for replaceably holding sheet sandpaper 26, for preventing sheet sandpaper 26 held therein from unintentional removal therefrom during use, and for not collapsing under heavy pressure from hand 22 of user 24 during use

30 top surface of body 28

32 bottom surface of body 28

34 pair of side surfaces of body 28 for providing working surfaces for sanding

36 pair of end surfaces of body 28

38 sandpaper-holding blind slot of body 28 for replaceably holding sheet sandpaper 26 and for preventing sheet sandpaper 26 held therein from unintentional removal therefrom during use

40 top of sandpaper-holding blind slot 38 of body 28

42 bottom surface of sandpaper-holding blind slot 38 of body 28

44 pair of side surfaces of sandpaper-holding blind slot 38 of body 28

46 pair of ends of sandpaper-holding blind slot 38 of body 28

48 pair of terminal edges of sandpaper-holding blind slot 38 of body 28 for preventing sheet sandpaper 26 held in sandpaper-holding blind slot 38 of body 28 from unintentional removal therefrom during use

First Method of Loading Sheet Sandpaper 26 onto Hand-Held Sanding Block 20

50 pair of upper axial edges of body 28

52 pair of lower axial edges of body 28

53 abrasive surface of sheet sandpaper 26

53*a* non-abrasive surface of sheet sandpaper 26

54 ½ sheet sandpaper of sheet sandpaper 26

56 pair of long edges of ½ sheet sandpaper 54 of sheet sandpaper 26

58 pair of short edges of ½ sheet sandpaper 54 of sheet sandpaper 26

60 first inserted portion of ½ sheet sandpaper 54 of sheet sandpaper 26

62 first top portion of ½ sheet sandpaper 54 of sheet sandpaper 26

64 first side portion of ½ sheet sandpaper 54 of sheet sandpaper 26

66 bottom portion of ½ sheet sandpaper 54 of sheet sandpaper 26

68 second side portion of ½ sheet sandpaper 54 of sheet sandpaper 26

70 second top portion of ½ sheet sandpaper 54 of sheet sandpaper 26

72 second insert portion of ½ sheet sandpaper 54 of sheet sandpaper 26

Second Method of Loading Sheet Sandpaper 26 onto Hand-Held Sanding Block 20

154 doubled ½ sheet sandpaper of sheet sandpaper 26

156 pair of free long edges of doubled ½ sheet sandpaper 154 of sheet sandpaper 26

157 folded long edge of doubled ½ sheet sandpaper 154 of sheet sandpaper 26

158 two pair of short edges of doubled ½ sheet sandpaper 154 of sheet sandpaper 26

160 first inserted portion of doubled ½ sheet sandpaper 154 of sheet sandpaper 26

162 first top portion of doubled ½ sheet sandpaper 154 of sheet sandpaper 26

164 first side portion of doubled ½ sheet sandpaper 154 of sheet sandpaper 26

166 bottom portion of doubled ½ sheet sandpaper 154 of sheet sandpaper 26

168 second side portion of doubled ½ sheet sandpaper 154 of sheet sandpaper 26

170 second top portion of doubled ½ sheet sandpaper 154 of sheet sandpaper 26

172 second insert portion of doubled ½ sheet sandpaper 154 of sheet sandpaper 26

DETAILED DESCRIPTION OF THE PREFERRED EMBODIMENTS

Introductory

Referring now to the figures, in which like numerals indicate like parts, and particularly to FIG. 1, the hand-held sanding block of the embodiments of the present invention is shown generally at 20 for being used by a hand 22 of a user 24, for replaceably holding sheet sandpaper 26, for preventing the sheet sandpaper 26 held therein from unintentional removal therefrom during use, and for not collapsing under heavy pressure from the hand 22 of the user 24 during use.

Configuration of the Hand-Held Sanding Block 20

The configuration of the hand-held sanding block 20 can best be seen in FIGS. 2-6, and as such, will be discussed with reference thereto.

The hand-held sanding block 20 comprises a body 28. The body 28 is for being used by the hand 22 of the user 24, for replaceably holding the sheet sandpaper 26, for preventing the sheet sandpaper 26 held therein from unintentional removal therefrom during use, and for not collapsing under the heavy pressure from the hand 22 of the user 24 during use.

The body 28 is only one-piece, completely solid, and completely not hollow for not coming apart under the heavy pressure from the hand 22 of the user 24 during use and for not collapsing under the heavy pressure from the hand 22 of the user 24 during use.

The body 28 is rectangular-parallelepiped-shaped, and as such, has a top surface 30, a bottom surface 32 that is flat for providing a working surface for sanding, a pair of side surfaces 34, and a pair of end surfaces 36.

The top surface 30 of the body 28 is flat, parallel to, disposed over, and spaced from, the bottom surface 32 of the body 28.

The pair of side surfaces 34 of the body 28 are flat for providing working surfaces for sanding, parallel to each other, and spaced-apart from each other.

The pair of end surfaces 36 of the body 28 are flat, parallel to, and spaced-apart from, each other.

The body 28 further has a sandpaper-holding blind slot 38.

The sandpaper-holding blind slot 38 of the body 28 is disposed in the top surface 30 of the body 28, extends from, and opens into, one end surface 36 of the body 28 to, and opens into, the other end surface 36 of the body 28, is parallel to, and equally spaced inwardly from, the pair of side surfaces 34 of the body 28, is for replaceably holding the sheet sandpaper 26, and is for preventing the sheet sandpaper 26 held therein from unintentional removal therefrom during use.

Figure 3:
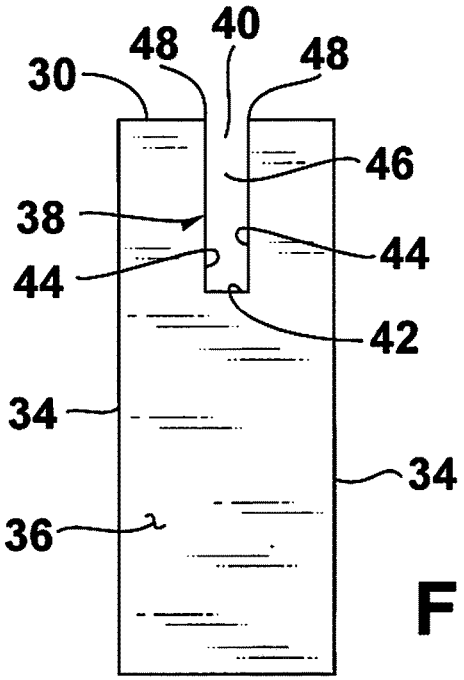
FIG. 3 is an end elevational view taken in the direction of either arrow 3 in FIG. 2.
Figure 4:
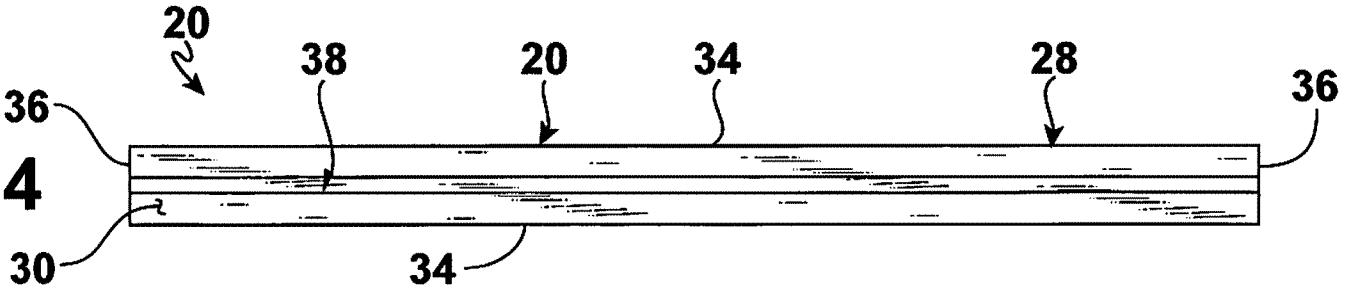
FIG. 4 is a top plan view taken in the direction of arrow 4 in FIG. 2.
Figure 5:
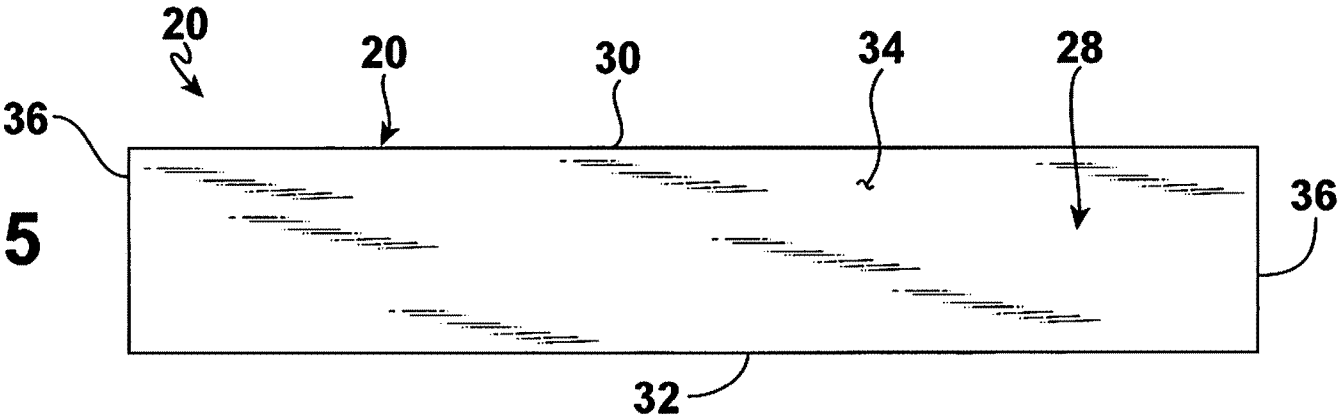
FIG. 5 is a side elevational view taken in the direction of either arrow 5 in FIG. 2.
Figure 6:
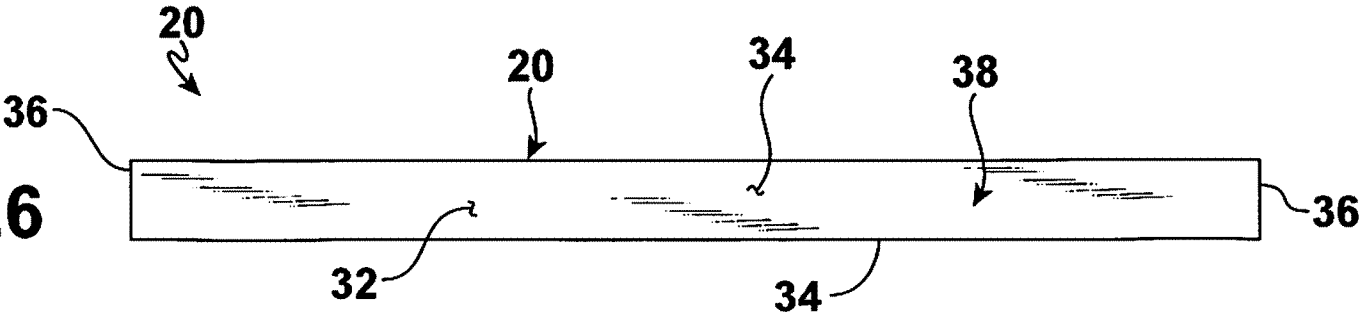
FIG. 6 is a bottom plan view taken in the direction of arrow 6 in FIG. 2.
Figures 7, 8:
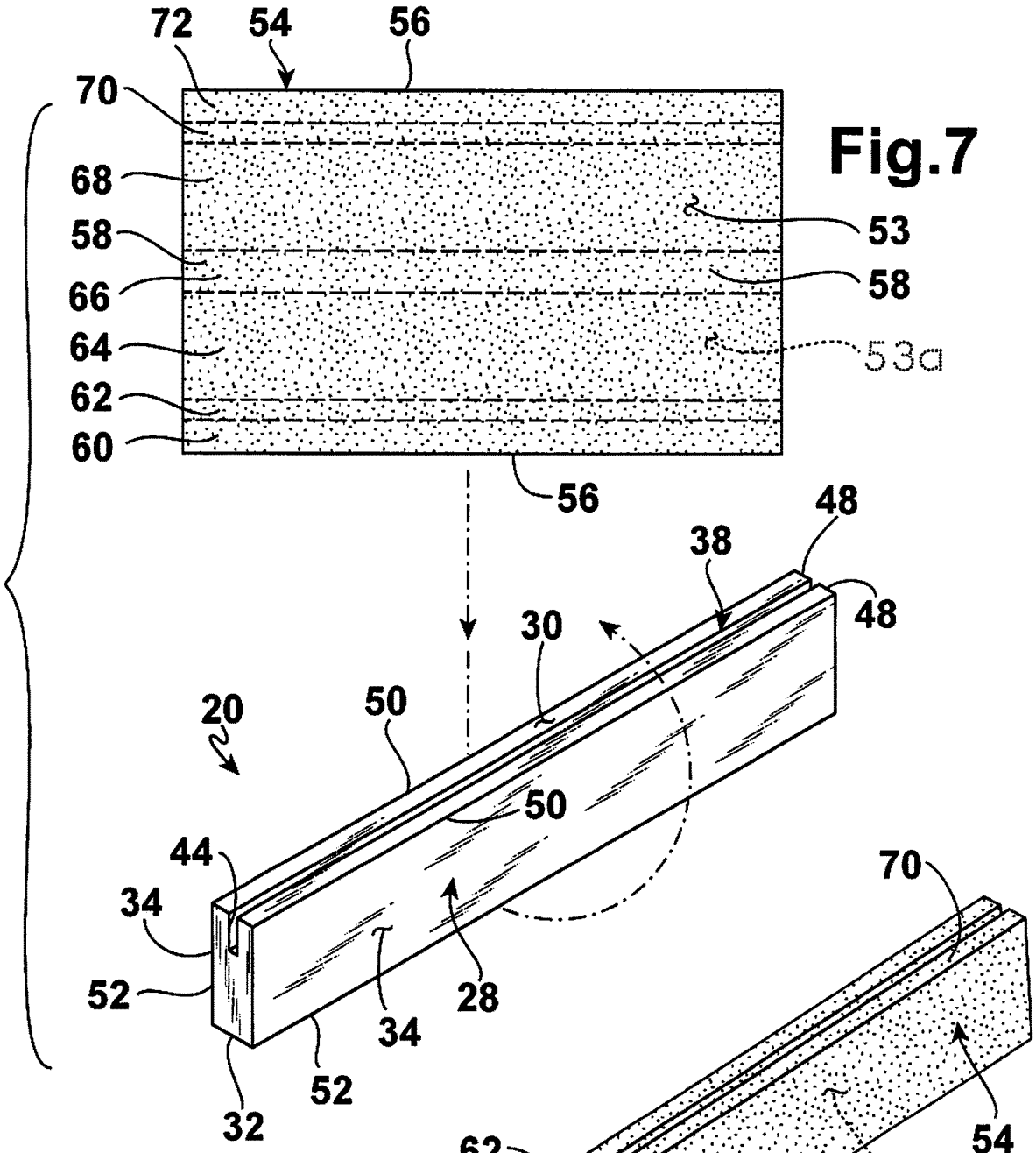
FIG. 7 is a diagrammatic view illustrating how exactly a half sheet of cooperating sandpaper is folded so that it may be installed to cover the entire outer surface of the sanding block shown in FIG. 2 with a grit side facing outwardly.
FIG. 8 is a diagrammatic perspective view illustrating an embodiment of the sanding block after sandpaper is installed thereon with a grit side facing outwardly and a paper side facing inwardly.
Figure 9:
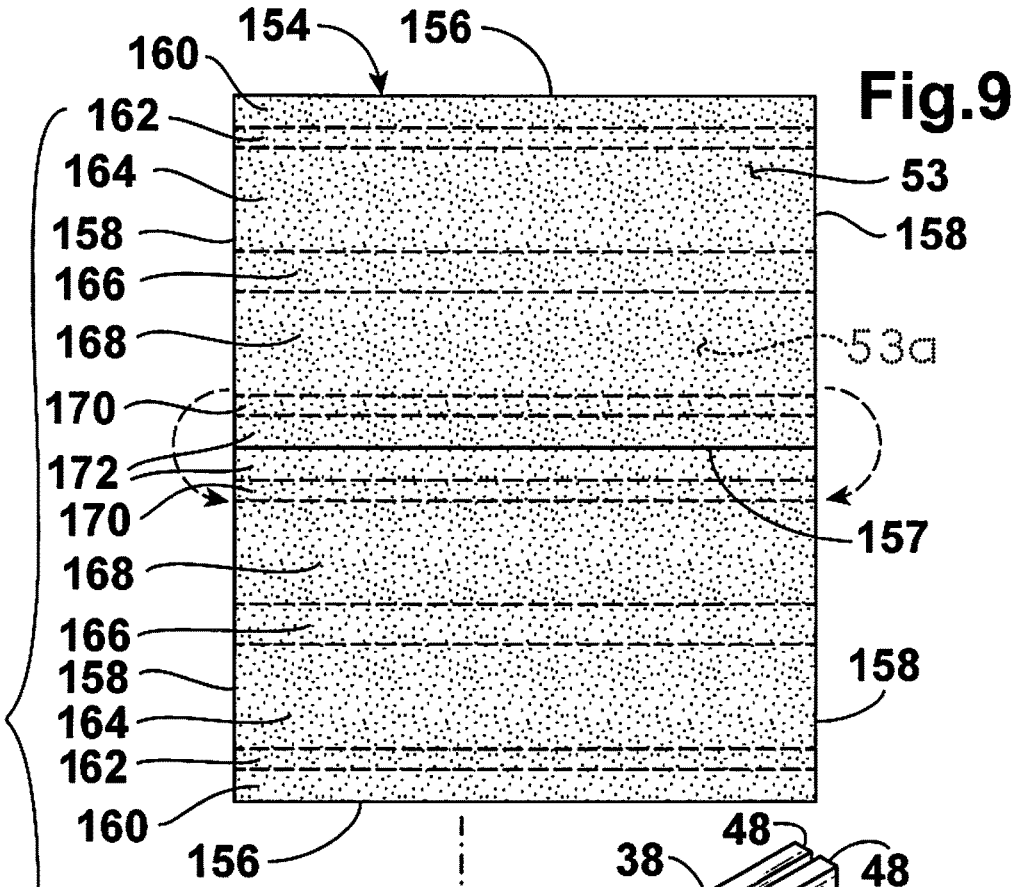
FIG. 9 is a diagrammatic view illustrating how exactly a full sheet of cooperating sandpaper is folded so that it may be installed to cover the entire outer surface of the sanding block shown in FIG. 2 with a grit side facing outwardly.
Figure 10:
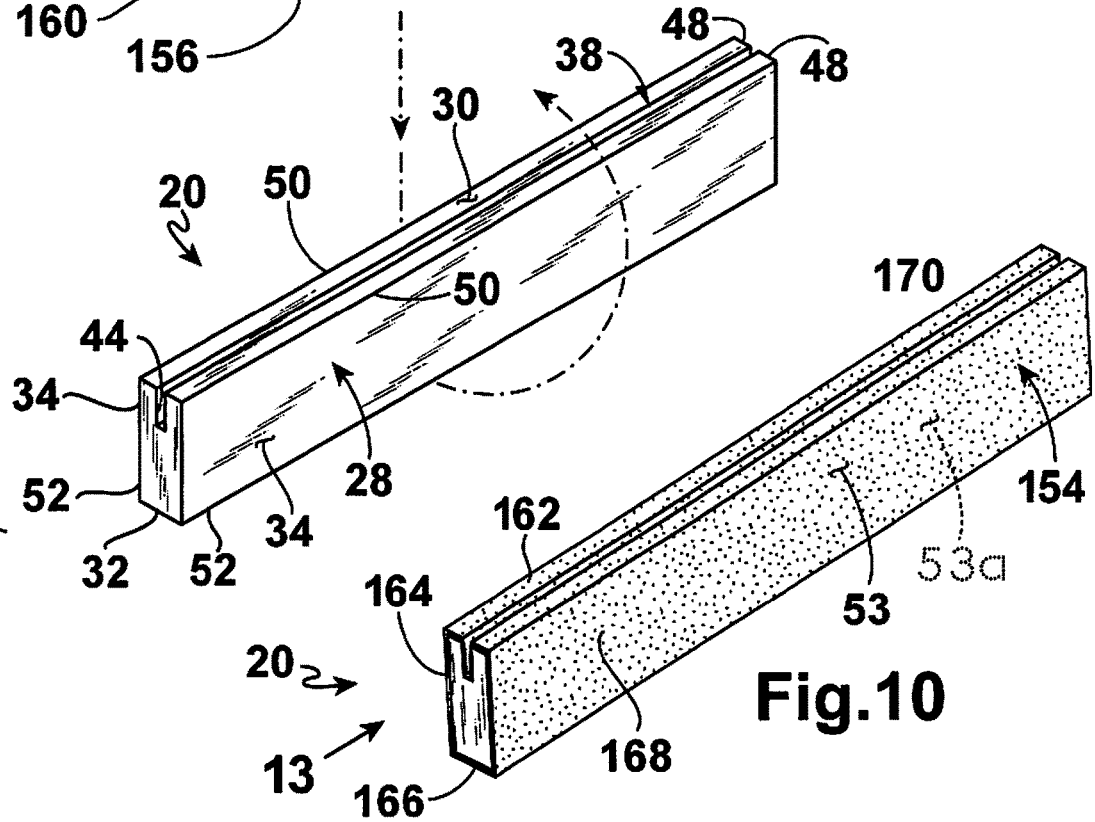
FIG. 10 is a diagrammatic perspective view illustrating an embodiment of the sanding block after sandpaper is installed thereon with a grit side facing outwardly and a grit side facing inwardly.
Figure 11:
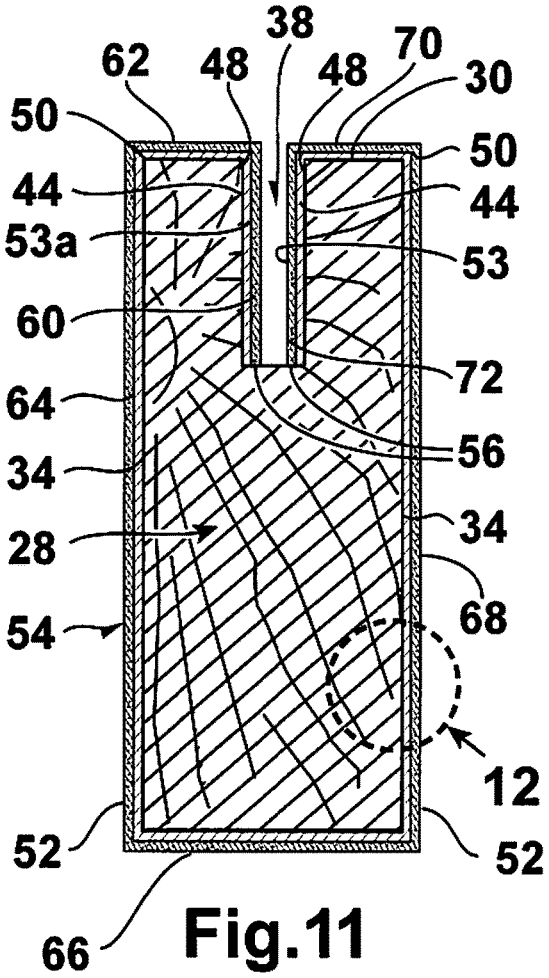
FIG. 11 is an enlarged diagrammatic end view taken in the direction of arrow 11 in FIG. 8.
Figure 13:
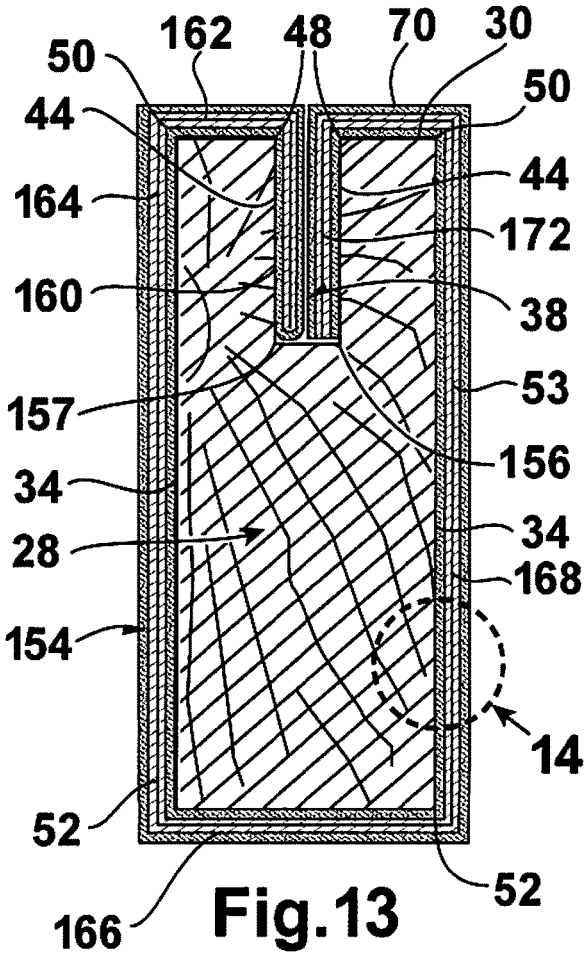
FIG. 13 is an enlarged diagrammatic end view taken in the direction of arrow 13 in FIG. 10.
Figure 12:
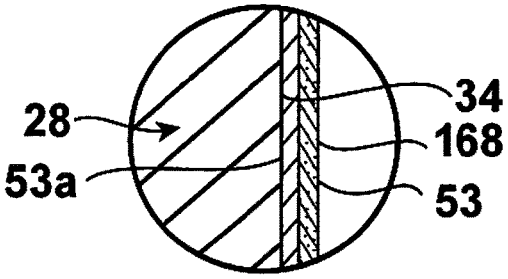
FIG. 12 is a further enlarged view, of the area enclosed by the dotted circle indicated by arrow 12 in FIG. 11, illustrating juxtaposed layers of materials.
Figure 14:
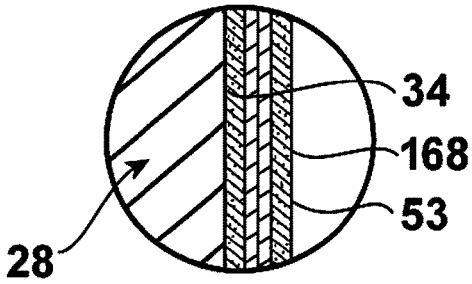
FIG. 14 is a further enlarged view, of the area enclosed by the dotted circle indicated by arrow 14 in FIG. 13, illustrating juxtaposed layers of materials.

As shown in FIG. 3, the sandpaper-holding blind slot 38 of the body 28 is rectangular-parallelepiped-shaped, and as such, is defined by a top 40, a bottom surface 42, a pair of side surfaces 44, and a pair of ends 46.

The top 40 of the sandpaper-holding blind slot 38 of the body 28 opens into the top surface 30 of the body 28.

The bottom surface 42 of the sandpaper-holding blind slot 38 of the body 28 is flat, and parallel to, and spaced between, the top surface 30 of the body 28 and the bottom surface 32 of the body 28.

The pair of side surfaces 44 of the sandpaper-holding blind slot 38 of the body 28 are flat, parallel to each other, and parallel to, and spaced between, the pair of side surfaces 34 of the body 28.

The pair of ends 46 of the sandpaper-holding blind slot 38 of the body 28 open into the pair of end surface 36 of the body 28, respectively.

The pair of side surfaces 44 of the sandpaper-holding blind slot 38 of the body 28 meet the top surface 30 of the body 28 at a pair of terminal edges 48, respectively The pair of terminal edges 48 of the sandpaper-holding blind slot 38 of the body 28 are parallel to each other, and extend axially along the top surface 30 of the body 28, from one end surface 36 of the body 28 to the other end surface 36 of the body 28.

The pair of terminal edges 48 of the sandpaper-holding blind slot 38 of the body 28 have entire lengths, are squared off along the entire length thereof so as to be complementary, and along the entire length thereof are not at least one of rounded, chamfered, and beveled for preventing the sheet sandpaper 26 held in the sandpaper-holding blind slot 38 of the body 28 from unintentional removal therefrom during use by virtue of the sheet sandpaper 26 being bent around a pair of 90° right angles of the pair of terminal edges 48 of the sandpaper-holding blind slot 38 of the body 28, as opposed to being bent around a pair of rounded, chamfered, or beveled angles of a pair of terminal edges 48 of the sandpaper-holding blind slot 38 of the body 28.

First Method of Loading the Sheet Sandpaper 26 onto the Hand-Held Sanding Block 20

The first method of loading the sheet sandpaper 26 onto the hand-held sanding block 20 can best be seen in FIGS. 7, 8, 11, and 12, and as such, will be discussed with reference thereto.

The pair of side surfaces 34 of the body 28 meet the top surface 30 of the body 28 at a pair of upper axial edges 50, and meet the bottom surface 32 of the body 28 at a pair of lower axial edges 52.

The sheet sandpaper 26 is a standard 9"×11", has an abrasive surface 53 and a non-abrasive surface 53*a*, and is cut in half to be a ½ sheet sandpaper 54 that is 9"×54", and as such, has a pair of long edges 56 and a pair of short edges 58.

STEP 1: Insert one long edge 56 of the ½ sheet sandpaper 54 of the sheet sandpaper 26 into the sandpaper-holding blind slot 38 of the body 28 so as to form a first inserted portion 60, with the non-abrasive surface 53*a* of the ½ sheet sandpaper 54 of the sheet sandpaper 26 resting against one side surface 44 of the sandpaper-holding blind slot 38 of the body 28;

STEP 2: Bend the ½ sheet sandpaper 54 of the sheet sandpaper 26 outwardly over an adjacent terminal edge 48 of the sandpaper-holding blind slot 38 of the body 28, onto the top surface 30 of the body 28, so as to form a first top portion 62;

STEP 3: Bend the ½ sheet sandpaper 54 of the sheet sandpaper 26 downwardly over an adjacent upper axial edge 50 of the body 28, onto an adjacent side surface 34 of the body 28, so as to form a first side portion 64;

STEP 4: Bend the ½ sheet sandpaper 54 of the sheet sandpaper 26 inwardly over an adjacent lower axial edge 52 of the body 28, onto the bottom surface 32 of the body 28, so as to form a bottom portion 66;

STEP 5: Bend the ½ sheet sandpaper 54 of the sheet sandpaper 26 upwardly over the other lower axial edge 52 of the body 28, onto the other side surface 34 of the body 28, so as to form a second side portion 68;

STEP 6: Bend the ½ sheet sandpaper 54 of the sheet sandpaper 26 inwardly over the other upper axial edge 50 of the body 28, onto the top surface 30 of the body 28, so as to form a second top portion 70; and STEP 7: Bend the ½ sheet sandpaper 54 of the sheet sandpaper 26 downwardly over the other terminal edge 48 of the sandpaper-holding blind slot 38 of the body 28, onto the other side surface 44 of the sandpaper-holding blind slot 38 of the body 28, so as to form a second insert portion 72.

Second Method of Loading the Sheet Sandpaper 26 onto the Hand-Held Sanding Block 20

The second method of loading the sheet sandpaper 26 onto the hand-held sanding block 20 can best be seen in FIGS. 9, 10, 13, 14, and 15A-15E, and as such, will be discussed with reference thereto.

STEP 1: Fold the sheet sandpaper 26 in half to form a doubled ½ sheet sandpaper 154 having a pair of free long edges 156, a folded long edge 157, and two pair of short edges 158;

STEP 2: Insert the folded long edge 157 of the doubled ½ sheet sandpaper 154 of the sheet sandpaper 26 into the sandpaper-holding blind slot 38 of the body 28 so as to form a first inserted portion 160, with the abrasive surface 53 of the doubled ½ sheet sandpaper 154 of the sheet sandpaper 26 engaging against one side surface 44 of the sandpaper-holding blind slot 38 of the body 28 for preventing the first inserted portion 160 of the doubled ½ sheet sandpaper 154 of the sheet sandpaper 26 from unintentional removal from the sandpaper-holding blind slot 38 of the body 28;

STEP 3: Bend the doubled ½ sheet sandpaper 154 of the sheet sandpaper 26 outwardly over an adjacent terminal edge 48 of the sandpaper-holding blind slot 38 of the body 28, onto the top surface 30 of the body 28, so as to form a first top portion 162;

STEP 4: Bend the doubled ½ sheet sandpaper 154 of the sheet sandpaper 26 downwardly over an adjacent upper axial edge 50 of the body 28, onto an adjacent side surface 34 of the body 28, so as to form a first side portion 164;

STEP 5: Bend the doubled ½ sheet sandpaper 154 of the sheet sandpaper 26 inwardly over an adjacent lower axial edge 52, onto the bottom surface 32 of the body 28, so as to form a bottom portion 166;

STEP 6: Bend the doubled ½ sheet sandpaper 154 of the sheet sandpaper 26 upwardly over the other lower axial edge 52, onto the other side surface 34 of the body 28, so as to form a second side portion 168;

STEP 7: Bend the doubled ½ sheet sandpaper 154 of the sheet sandpaper 26 inwardly over the other upper axial edge 50, onto the top surface 30 of the body 28, so as to form a second top portion 170; and STEP 8: Bend the doubled ½ sheet sandpaper 154 of the sheet sandpaper 26 downwardly over the other terminal edge 48 of the sandpaper-holding blind slot 38 of the body 28, onto the other side surface 44 of the sandpaper-holding blind slot 38 of the body 28, so as to form a second insert portion 172 being the pair of free long edges 156 of the doubled ½ sheet sandpaper 154 of the sheet sandpaper 26, with the abrasive surface 53 of the doubled ½ sheet sandpaper 154 of the sheet sandpaper 26 engaging against the other side surface 44 of the sandpaper-holding blind slot 38 of the body 28 for preventing the second inserted portion 160 of the doubled ½ sheet sandpaper 154 of the sheet sandpaper 26 from unintentional removal from the sandpaper-holding blind slot 38 of the body 28.

Impressions

It will be understood that each of the elements described above, or two or more together, may also find a useful application in other types of constructions differing from the types described above.

While the invention has been illustrated and described as embodiments of a sanding block, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A method of loading sheet sandpaper onto a hand-held sanding block, wherein the sheet sandpaper:

a) has an abrasive surface; and b) is 9"×11";

wherein the hand-held sanding block has a body with:

a) a top surface;

b) a pair of upper axial edges;

c) a pair of lower axial edges;

d) a pair of side surfaces;

e) a pair of end surfaces; and f) a sandpaper-holding blind slot defined by:

i) a pair of side surfaces; and ii) a pair of terminal edges;

wherein said method comprising the steps of:

a) folding the sheet sandpaper in half to form a doubled ½ sheet sandpaper having a pair of free long edges, a folded long edge, and two pair of short edges, and being 9"×5½";

b) inserting the folded long edge of the doubled ½ sheet sandpaper of the sheet sandpaper into the sandpaper-holding blind slot of the body so as to form a first inserted portion, with the abrasive surface of the doubled ½ sheet sandpaper of the sheet sandpaper engaging against one side surface of the sandpaper-holding blind slot of the body for preventing the first inserted portion of the doubled ½ sheet sandpaper of the sheet sandpaper from unintentional removal from the sandpaper-holding blind slot of the body;

c) bending the doubled ½ sheet sandpaper of the sheet sandpaper outwardly over an adjacent terminal edge of the sandpaper-holding blind slot of the body, onto the top surface of the body, so as to form a first top portion;

d) bending the doubled ½ sheet sandpaper of the sheet sandpaper downwardly over an adjacent upper axial edge of the body, onto an adjacent side surface of the body, so as to form a first side portion;

e) bending the doubled ½ sheet sandpaper of the sheet sandpaper inwardly over an adjacent lower axial edge, onto the bottom surface of the body, so as to form a bottom portion;

f) bending the doubled ½ sheet sandpaper of the sheet sandpaper upwardly over the other lower axial edge, onto the other side surface of the body, so as to form a second side portion;

g) bending the doubled ½ sheet sandpaper of the sheet sandpaper inwardly over the other upper axial edge, onto the top surface of the body, so as to form a second top portion; and h) bending the doubled ½ sheet sandpaper of the sheet sandpaper downwardly over the other terminal edge of the sandpaper-holding blind slot of the body, onto the other side surface of the sandpaper-holding blind slot of the body, so as to form a second insert portion being the pair of free long edges of the doubled ½ sheet sandpaper of the sheet sandpaper, with the abrasive surface of the doubled ½ sheet sandpaper of the sheet sandpaper engaging against the other side surface of the sandpaper-holding blind slot of the body for preventing the second inserted portion of the doubled ½ sheet sandpaper of the sheet sandpaper from unintentional removal from the sandpaper-holding blind slot of the body.

2. The method of claim 1, wherein the body is only one-piece, completely solid, and completely not hollow for not coming apart under heavy pressure from the hand of the user during use and for not collapsing under heavy pressure from the hand of the user during use.

3. The method of claim 1, wherein the body is rectangular-parallelepiped-shaped.

4. The method of claim 1, wherein the body has a pair of end surfaces.

5. The method of claim 1, wherein the top surface of the body is parallel to the bottom surface.

6. The method of claim 1, wherein the top surface of the body is disposed over the bottom surface.

7. The method of claim 1, wherein the top surface of the body is spaced from the bottom surface.

8. The method of claim 1, wherein the pair of side surfaces of the body are flat for providing working surfaces for sanding.

9. The method of claim 1, wherein the pair of side surfaces of the body are parallel to each other.

10. The method of claim 1, wherein the pair of side surfaces of the body are spaced-apart from each other.

11. The method of claim 4, wherein the pair of end surfaces of the body are flat.

12. The method of claim 4, wherein the pair of end surfaces of the body are parallel to each other.

13. The method of claim 4, wherein the pair of end surfaces of the body are spaced-apart from each other.

14. The method of claim 1, wherein the sandpaper-holding blind slot of the body is disposed in the top surface of the body.

15. The method of claim 4, wherein the sandpaper-holding blind slot of the body extends from one end surface of the body to the other end surface of the body.

16. The method of claim 4, wherein the sandpaper-holding blind slot of the body opens into one end surface of the body.

17. The method of claim 4, wherein the sandpaper-holding blind slot of the body opens into the other end surface of the body.

18. The method of claim 1, wherein the sandpaper-holding blind slot of the body is parallel to the pair of side surfaces of the body.

19. The method of claim 1, wherein the sandpaper-holding blind slot of the body is equally spaced inwardly from the pair of side surfaces of the body.

20. The method of claim 1, wherein the sandpaper-holding blind slot of the body is rectangular-parallelepiped-shaped.

21. The method of claim 1, wherein the sandpaper-holding blind slot of the body is defined by a top.

22. The method of claim 1, wherein the sandpaper-holding blind slot of the body is defined by a bottom surface.

23. The method of claim 1, wherein the sandpaper-holding blind slot of the body defined by a pair of ends.

24. The method of claim 21, wherein the top of the sandpaper-holding blind slot of the body opens into the top surface of the body.

25. The method of claim 22, wherein the bottom surface of the sandpaper-holding blind slot of the body is flat.

26. The method of claim 22, wherein the bottom surface of the sandpaper-holding blind slot of the body is parallel to the top surface of the body; and wherein the bottom surface of the sandpaper-holding blind slot of the body is parallel to the bottom surface of the body.

27. The method of claim 22, wherein the bottom surface of the sandpaper-holding blind slot of the body is spaced between the top surface of the body and the bottom surface of the body.

28. The method of claim 1, wherein the pair of side surfaces of the sandpaper-holding blind slot of the body are flat.

29. The method of claim 1, wherein the pair of side surfaces of the sandpaper-holding blind slot of the body are parallel to each other.

30. The method of claim 1, wherein the pair of side surfaces of the sandpaper-holding blind slot of the body are parallel to the pair of side surfaces of the body.

31. The method of claim 1, wherein the pair of side surfaces of the sandpaper-holding blind slot of the body are spaced between the pair of side surfaces of the body.

32. The method of claim 23, wherein the pair of ends of the sandpaper-holding blind slot of the body open into the pair of end surfaces of the body, respectively.

33. The method of claim 1, wherein the pair of side surfaces of the sandpaper-holding blind slot of the body meet the top surface of the body at the pair of terminal edges of the sandpaper-holding blind slot of the body, respectively.

34. The method of claim 1, wherein the pair of terminal edges of the sandpaper-holding blind slot of the body are parallel to each other.

35. The method of claim 1, wherein the pair of terminal edges of the sandpaper-holding blind slot of the body extend axially along the top surface of the body, from one end surface of the body to the other end surface of the body.

36. The method of claim 1, wherein the pair of terminal edges of the sandpaper-holding blind slot of the body have entire lengths; and wherein the pair of terminal edges of the sandpaper-holding blind slot of the body are squared off along the entire length thereof so as to be complementary.

37. The method of claim 1, wherein the pair of terminal edges of the sandpaper-holding blind slot of the body are at least one of not rounded, not chamfered, and not beveled, for preventing the sheet sandpaper held in the sandpaper-holding blind slot of the body from unintentional removal therefrom during use by virtue of the sheet sandpaper being bent around a pair of 90° right angles of the pair of terminal edges of the sandpaper-holding blind slot of the body, as opposed to being bent around a pair of rounded, chamfered, or beveled angles of a pair of terminal edges of the sandpaper-holding blind slot of the body.

* * * * *